United States Patent [19]

Emblin

[11] Patent Number: 4,864,781

[45] **Date of Patent: * Sep. 12, 1989**

[54] MULTIPLE PANEL METAL ROOFING SYSTEM WITH OVERLAPPING PANEL EDGES

[76] Inventor: Robert T. Emblin, 5150 E. Paradise Dr., Scottsdale, Ariz. 85254

[ * ] Notice: The portion of the term of this patent subsequent to May 3, 2005 has been disclaimed.

[21] Appl. No.: 157,735

[22] Filed: Feb. 18, 1988

Related U.S. Application Data

[63] Continuation of Ser. No. 43,166, Apr. 27, 1987, which is a continuation of Ser. No. 608,350, May 8, 1984, abandoned, which is a continuation of Ser. No. 274,492, Jun. 17, 1981.

[51] Int. Cl.[4] ..... E04D 1/28

[52] U.S. Cl. ..... 52/58; 52/404; 52/94

[58] Field of Search ..... 52/58, 404, 90, 94, 52/173 R, 278, 394, 395, 417, 472, 478, 747, 748

[56] References Cited

U.S. PATENT DOCUMENTS

| | | | |
|---|---|---|---|
| 2,060,093 | 11/1936 | Markel | 108/13 |
| 2,781,877 | 2/1957 | Ochiltree | 189/86 |
| 2,832,300 | 4/1958 | Jacobson | 108/13 |
| 3,332,186 | 7/1967 | Cammaert | 52/302 |
| 3,353,316 | 11/1967 | Berg | 52/302 |
| 4,063,395 | 12/1977 | Stewart et al. | 52/309.5 |
| 4,741,132 | 5/1988 | Emblin | 52/58 |

*Primary Examiner*—David A. Scherbel
*Assistant Examiner*—Jerrold D. Johnson
*Attorney, Agent, or Firm*—Cahill, Sutton & Thomas

[57] ABSTRACT

A multiple panel metal roofing system is installed on a continuous roof deck. Elongated support members are aligned to create a supporting frame structure formed as a plurality of grid sections each having sides defining the perimeter of each grid section. A plurality of substantially planar outer skin sections are aligned with the grid sections such that the edges of adjacent skin sections overlap above the upper surface of the support members. A layer of sealant is positioned between the overlapping edges of adjacent skin sections. Fasteners such as screws penetrate through the overlapping edges of adjacent skin sections and the intervening layer of sealant and extend into the upper surface of the underlying support members to immovably secure the overlapping edges of adjacent skin sections to the underlying support members and to form a compressed watertight seal along the perimeter of each grid section. The area of each outer skin section lying inside the perimeter of each grid section is free to expand or contract in response to temperature changes without causing relative movement of the watertight seal formed along the perimeter of each grid section.

17 Claims, 4 Drawing Sheets

7
5
6
4

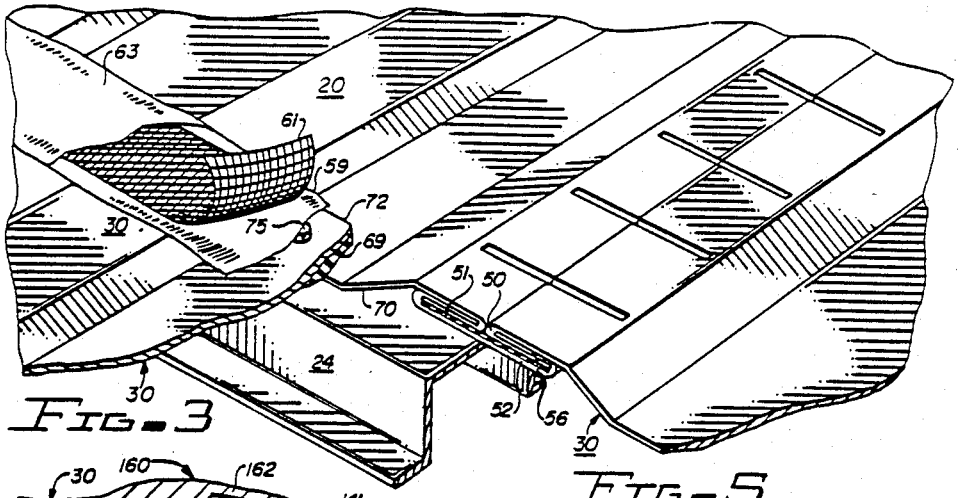
FIG. 3
FIG. 5
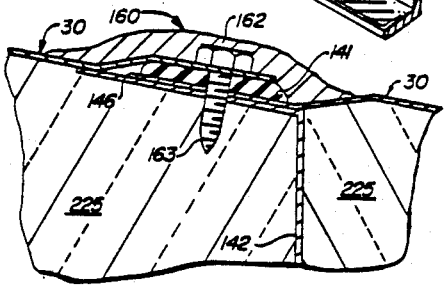
FIG. 4
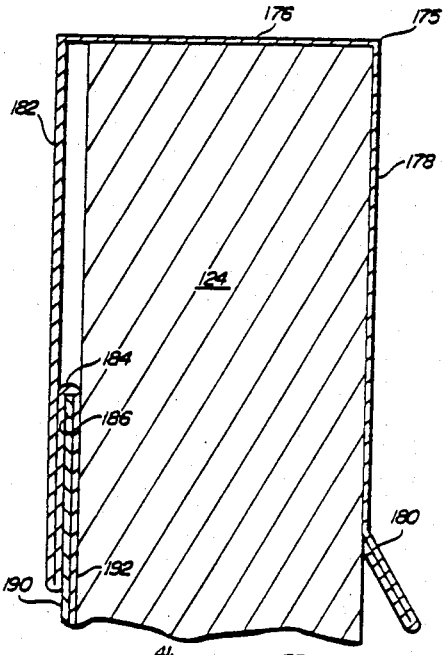
FIG. 6
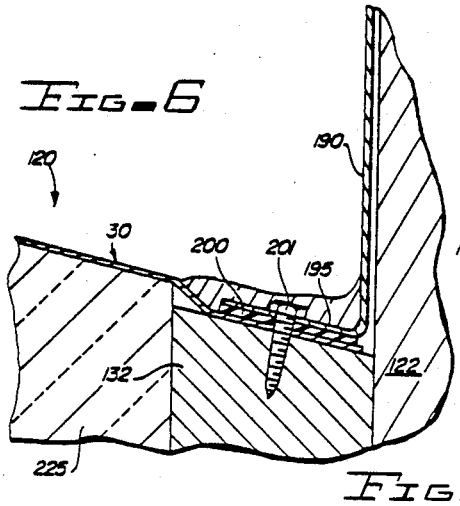
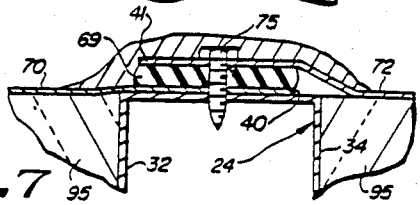
FIG. 7

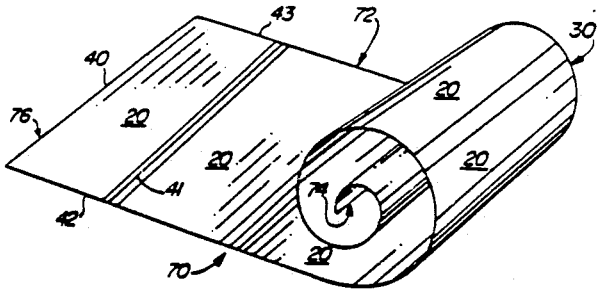
FIG-8
FIG-10
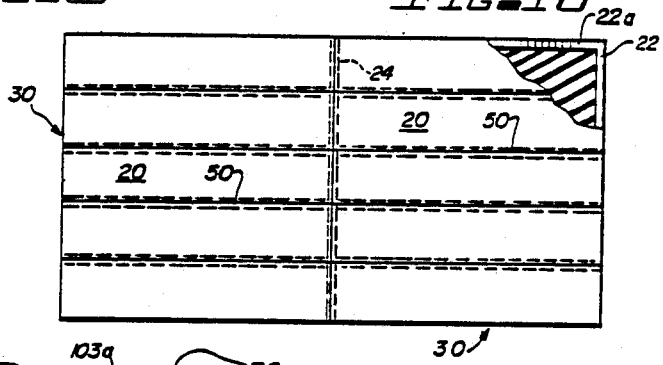
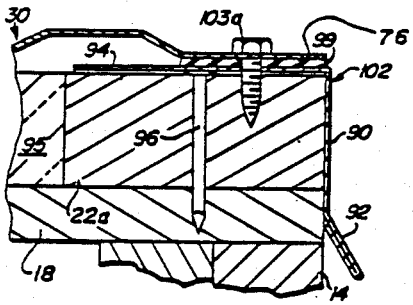
FIG-11
FIG-12
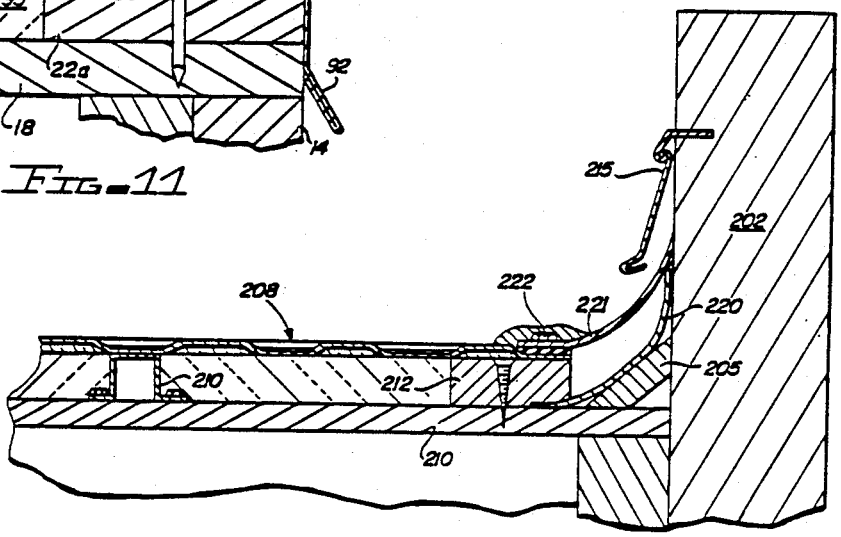

MULTIPLE PANEL METAL ROOFING SYSTEM WITH OVERLAPPING PANEL EDGES

This application is a continuation application of U.S. patent application Ser. No. 043,166, filed 4/27/87 and entitled "MULTIPLE PANEL METAL ROOFING SYSTEM WITH OVERLAPPING PANEL EDGES" (allowed but not issued) which is a continuation application of U.S. patent application Ser. No. 608,350, filed 5/8/84 and entitled "WATER IMPERVIOUS ROOF MEMBRANE" (now abandoned) which is a continuation application of Ser. No. 274,492, filed 6/17/81 and entitled "PREFABRICATED STRUCTURAL ROOFING."

FIELD OF THE INVENTION

This invention relates to roofing systems and more particularly relates to prefabricated structural roof systems.

DESCRIPTION OF THE PRIOR ART

Built-up roofing has been used for many years. Built-up roofing typically utilizes a deck of wood such as plywood supported on beams or rafters. The built-up system is constructed in place and the entire roof deck is covered by a continuous weather-proof membrane usually comprising alternate layers of felt and asphalt. The membrane is applied in a field operation. Once the membrane has been applied, gravel, rock or similar aggregate is spread upon the roof to give a resistance to wear resulting from weathering and foot traffic. Further, the aggregate serves to add weight to resist wind uplift. Typically, thermal insulation is applied at the inner side of the decking to minimize heat transfer through the deck.

Built-up systems present substantial problems where extreme temperature ranges of heat and cold are encountered. Expansion and contraction, particularly of a metal building system, can create substantial problems resulting in failure along the perimeter of the building when thermal movement is encountered.

In view of the substantial disadvantages to conventional built-up roof systems, a number of prefabricated roofing systems have been developed in the prior art. Such prior art prefabricated systems require substantial on-site construction and often do not make adequate provisions for sealing around obstructions such as roof-mounted equipment and parapets. Thus, leakage can result at these points as thermal movement of the roofing system occurs. Furthermore, water-tight integrity of such roofing systems is difficult to achieve and has led to various complicated and expensive systems using sealing membranes over the expanse of the roof surface.

Accordingly, there exists a need for a prefabricated system which can be quickly and easily erected with minimum labor and skill, which is reliably moisture-tight, and which is compatible with various building sizes, shapes and constructions.

SUMMARY OF THE INVENTION

The present invention comprises a multiple panel metal roofing system for installation on a continuous roof deck having a length and a width. The system includes a plurality of elongated support members aligned to create a supporting frame structure formed as a plurality of grid sections each having a plurality of sides defining the perimeter of each grid section. The base of each support member is rigidly secured to the roof deck and includes an upper surface spaced apart from the roof deck by a defined height. Filler means covers the roof deck within each grid section and extends upward from the roof deck to a height not exceeding the height of the support members. A plurality of substantially planar outer skin sections each includes an edge surface overlying the upper surface of the support members and is freely disposed over the filler means without bonding thereto within a single grid section. The intersection of the upper surface of the support members with the skin section edge surfaces and the edge surfaces of adjacent skin sections defines an elevated overlap zone. Sealant means is disposed within the elevated overlap zone of each grid section between the skin section and the adjacent skin sections. Securing means penetrates within the elevated overlap zone of each grid section through the skin section, the adjacent skin sections and the sealant means at spaced apart intervals to immovably secure the skin section and the adjacent skin sections to the underlying support members and to form a compressed watertight seal along the perimeter of each grid section. The area of each outer skin section lying within the perimeter of each grid section is free to expand or contract in response to temperature changes without causing relative movement of the watertight seal formed along the perimeter of each grid section.

DESCRIPTION OF THE DRAWINGS

Other objects of this invention will appear in the following description and claims, reference being made to the accompanying drawings forming a part of the specification wherein like reference characters designate corresponding parts in several views.

FIG. 3 is a detail perspective view of a portion of the roofing system;

FIG. 4 is an enlarged detail view of a portion of the roofing system as indicated in FIG. 2;

FIG. 5 is an enlarged detail view of a portion of the roofing system as indicated in FIG. 2;

FIG. 6 is an enlarged detail view of a portion of the roofing system as indicated in FIG. 2;

FIG. 7 is an enlarged detail view of a portion of the roofing system as indicated in FIG. 1;

FIG. 8 is a view illustrating a pre-formed coil of roofing skin;

FIG. 10 is a schematic plan view illustrating a typical layout of the roofing system of the present invention;

FIG. 11 is a detail view of an end edge flashing of the roofing system as shown in FIG. 1; and FIG. 12 is a cross-sectional view of the system applied by retrofit to an existing roof structure.

DETAILED DESCRIPTION

Figure 9:
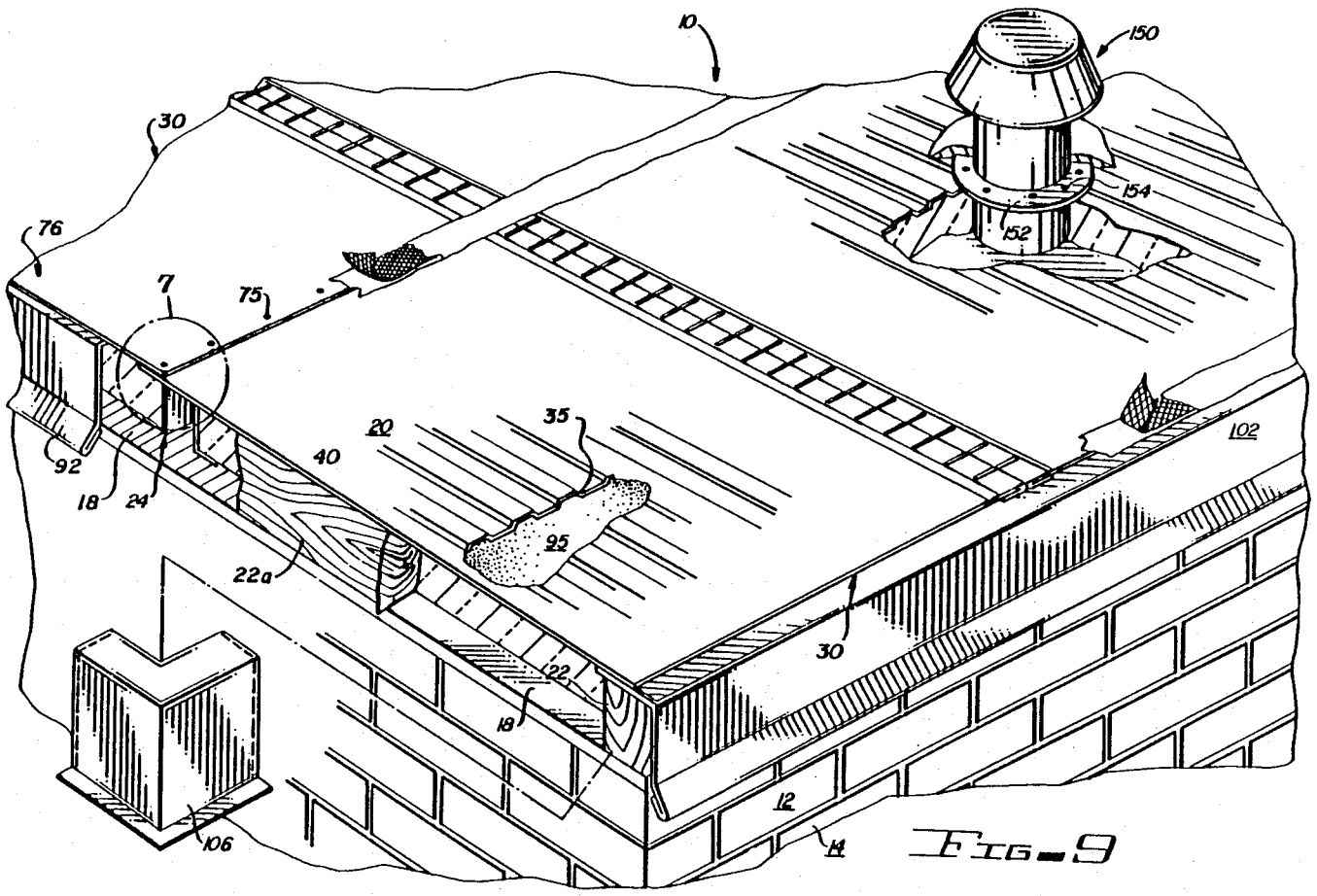
FIG. 9 is a perspective illustrating the roofing system of FIG. 2 as applied to a masonry building.

Referring now to the drawings, particularly FIG. 9, the roofing system generally designated 10 is shown in conjunction with a building 12 which may be of any construction. A conventional block wall 14 supports transversely extending rafters (not shown) which support a load bearing plywood deck 18. Roof system 10 comprises a supporting frame structure including a plurality of elongated support members 22, 22a and 24 disposed on top of deck 18.

Wood beam support members 22 and 22a are disposed along the peripheral edge and the purlin support members 24 are spaced in parallel relationship with respect to each other and extend upwardly a defined height from deck 18. As is evident in the drawings, purlin support members 24 are in parallel relationship to one edge of deck 18 along which edge wood beam support members 22 are disposed. Thus, the supporting frame structure includes a plurality of rectangular grid sections formed by elongated support members 22, 22a and 24. As best seen in FIG. 10, the rectangular grid sections have extended lengths measured in a first direction parallel to one edge of deck 18 and preselected widths measured in a second direction normal to the first direction of the extended lengths. Purlins 24 span across the entire deck 18 on building 12.

Figures 1, 2:
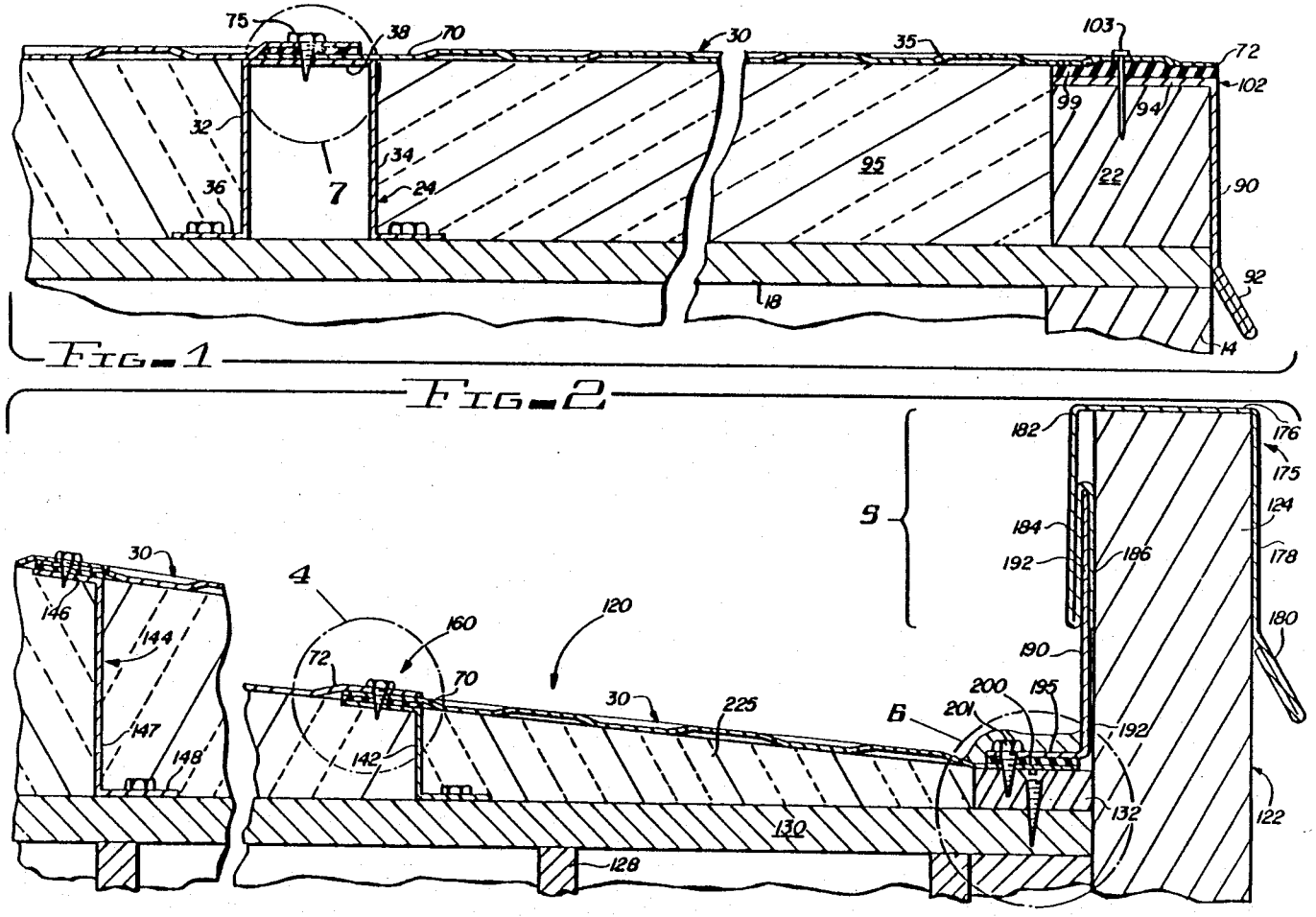
FIG. 1 is a cross-sectional view of a typical installation of the roofing system of the present invention.
FIG. 2 is a cross sectional view of an alternate installation.

As best seen in FIGS. 1, 7 and 9, each purlin 24 has a generally U-shaped cross sectional configuration with opposite vertically upstanding legs 32 and 34 and a flange 36 secured to deck 18. Horizontal web 38 extends between legs 32 and 34 and supports a lap seam along the length of purlin 24 where adjacent outer skin sections 30 and overlap at their outer edges as shown in the drawings.

As shown, rigid blocks of polyurethane or polystyrene insulation 95 are placed within each of the grid sections defined by the intersection of the longitudinal and transverse support members 22, 22a and 24. Blocks 95 are supported below by the continuous, load bearing roof deck 18 and extend up to the upper surface of support members 22, 22a and 24. Thus, there is a substantially continuous top surface over the top of the parallel elongated support members 22, 22a and 24 and insulation blocks or panels 95.

Filler means in the form of insulation 95 is placed on the deck between the supports 24. The insulation may be any suitable type such as polyurethane, polystyrene, rock wool, fiberglass or the like.

A plurality of prefabricated outer skin sections 30 are dimensioned to overlap the extended parallel supporting members 22 and 24 which define the extended predetermined lengths of each rectangular grid section of the supporting frame structure. Each outer skin section 30 is composed of a plurality of juxtaposed sheet metal panels 20. Each panel 20 has two opposed long length edges 40 and 41 and two opposed short width edges 42 and 43. Each pair of juxtaposed panels 20 are joined with a watertight seal at the adjacent long length edges 41 and 40, respectively.

The extended length of each outer skin section 30 is equal to the sum of all the short widths of the total number of juxtaposed sheet metal panels 20 joined together to form the outer skin section 30 as shown in FIG. 8. Thus, the outer edge 72 of section 30 is equal to the sum of all the short width edges 43 found on each one of the panels 20 and likewise, outer edge 70 is the sum of all of the short width edges 42 of the panels 20. The outer edges 76 and 78 of the skin section 30 are equal in length to the outer long width edges 40 and 41, respectively of the panels. That is, the length of the individually formed panels which are subsequently joined together along their opposed edges actually form the width of the outer skin section 30 which are dimensioned to overlap the parallel support members 22 and 42 which define opposed sides of each grid section of the supporting frame structure. In this specific embodiment, the opposed long side edges 40 and 41 of panels 20 is approximately twelve feet long. Typically, the short width edges 42 and 43 are in the range of three to four feet wide. The extended lengths of opposing edges 70 and 72 of the outer skin section 30 is of sufficient length to extend from one end of a grid section to the outer as shown in FIG. 10.

Each panel 20 used for prefabricating each outer skin section 30 is preformed from a continuous coil of sheet material such as 30-gauge galvanized or 0.24 inch aluminum sheet. Either the galvanized metal or the aluminum may be pre-painted. Thus, in other words, each outer skin section 30 is composed of a plurality of prefabricated sheets 20 of material with the skin section 30 having a resultant flexibility of a material composed of a 30-gauge galvanized sheet metal or a sheet of aluminun having a thickness of 0.24 inch.

Each of the sheet metal panel 20 are cut from a continuous coil that is typically three to four feet wide. The coil of sheet material is extended and cut into the individual panels 20. In this specific embodiment, the individual panels 20 are run through a pattern machine to apply corrugations 35 which extend parallel to the opposed long length edges 40 and 41. Corrugations 35 serve to stiffen and strengthen the resulting skin section 30. At the same time, corrugations 35 serve to allow for expansion and contraction of the roof without placing unnecessary stress on the structure which might otherwise cause the roof to lift or cause the panels 20 to rear away from the supporting structure members 20, 22a and 24 which would thus cause damage to the integrity of the roof.

Stated another way, the outer skin sections 30 are freely disposed over the top surface of filler means in the form of insulation panels 95 without bonding thereto with the outer edges 70 and 72 of outer skin section 30 being registered with the parallel support members 22 and 24 to which said edges 70 and 72 are fixedly secured with mechanical fastener means 75. As depicted in FIGS. 4, 7 and 10, an elevated four layer overlap zone is formed above and around the elevated profile surface of the perimeter of each grid section by the upper surface of support member 24 and the overlapping edge surfaces of skin section 30, an adjacent skin section 30 and an intermediate layer of sealant 69. The elevated four layer overlap zone may be defined by the intersection of flange 146, skin section 30, an adjacent outer skin section 30 and sealant 69 as depicted in FIG. 4 or by the upper surface of perimeter piece 132, skin section 30, adjacent water barrier means such as flashing 195 and sealant 200 as depicted in FIG. 6 or by the similar four layer overlapping structure depicted in FIGS. 11 and 12. Thus, as stated above, the outer skin section 30 is allowed to freely expand and contract between the parallel support members 22 and 24 without placing unnecessary stress on the supporting structure 22, 22a and 24 thereby avoiding damage to any sealed watertight joint located at the outer edges 70 and 72 of the outer skin section 30.

Returning to the manner in which outer skin sections 30 are constructed in this embodiment, the longitudinally opposed edges 40 and 41 of each individual, juxtaposed panel 20 are bent into a generally U-shaped bend 50. The bent or crimped edges 40 and 41 are joined together by cleats 52 as shown in FIG. 3. Each cleat 52 includes reversely bent lips 56 which are inserted between the crimped or bent edges 40 and 41 as shown in FIG. 3. A layer of sealant material 51 such as cleat cement sold by Elixir Industries of Gardena, California, is inserted in the crimped junction. The joined edge structure is then compressed up to a 150 ton press pressure.

The prefabrication of the outer skin sections 30 is accomplished away from the construction site. The crimping, cleat joining and sealing operation is repeated and individual panels 20 are joined until the desired length of the outer skin section 30 is fabricated to a predetermined, convenient length for handling. The outer skin section 30 has a flexibility such that it may be rolled into a coil as shown in FIG. 8. The coiled skin section 30 is then transported to the job site where it is secured in place in accordance with the invention.

The above procedure converts a continuous roll of sheet material such as galvanized steel or aluminum into a full sized, water impervious or watertight roof skin section having any desired length and width. As is evident herein, the skin section 30 is composed of a single ply sheet metal as clearly evidenced in the drawings.

The joining of the pairs of juxtaposed panels 20 along their length edges 40 and 41 produces the generally rectangular, elongated outer skin section 30 having opposite side edges 70 and 72 and end edges 74 and 756 as shown in FIGS. 3 and 8. When loaded in place, side edge 72 laps over the side edge 70 of a juxtaposed outer skin section 30. A suitable sealant 69 such as "Mobilelastic" commercially available from Elixir Industries of Gardena, California is placed between the panel edges 70 and 72 to create a primary sealed overlapping junction between adjacent outer skin roof sections 20.

Compressive sealant means or mechanical fasteners such as zinc-coated, self-tapping sheet metal screws 75 are secured at closely spaced apart intervals of, for example, one and one fourth inch along the entire overlapping length of the skin edges as shown. The screws 75 penetrate the overlapping panel edges 70 and 72 and the upper web 38 of purlin support member 24. Thus, screws 75 secure the overlapping skin edges 70 and 72 together with the coupled panels directly to the support member 24. Furthermore, a compressive force is exerted between the overlapping panel edges 70 and 72 and the sealant 69.

To further ensure the watertight integrity of the system, a secondary sealant layer is applied over the mechanical fastening screws 75 and the overlapping edges 70 and 72 of the adjacent skin sections 30. It is recommended that an area extending several inches from either side of the overlapping area be first brushed with a coat of fibrous plastic sealant material 59 such as the commercially available "Plasticoat Sealant" produced by Elixir Industries. Membrane 61 is then applied over the sealant layer 59 and a second layer 63 of "Plasticoat Sealant" is then applied over membrane 61 as shown.

By applying this sealant means over the mechanical fastener means 75 and the overlapped joint, the joined, juxtaposed skin sections 30 have an exterior mastic which prevents penetration of moisture. The sealant means creates a seal having a watertight integrity around the entire periphery of each grid section covered by the respective outer skin sections 30.

As is evident in the drawings, the outer skin sections 30 are freely disposed over the insulation panels 95 without bonding thereto. As discussed hereinabove, the only place where bonding and sealant materials are used are at the outer edges 70 and 72 of the skin sections 30 as they are disposed on the support members 22 and 24. The end edges 74 and 76 of the outer skins section 30 are fastened to the transverse support members **22*a* in a fashion discussed below regarding the outer edge of the panel as shown in FIG. 1**.

Referring to FIGS. 1, 9 and 11, the edges and sides of the building are provided with flashing to seal the system from entrance of water. To this end a flashing 102 is provided with a vertical edge section 90 having an angular flange 92 and a horizontal lip 94. The angular flange 92 is located and positioned along the vertical wall 14 of the building and overlaps the wall so that water is prevented from entering in the area 96 between the roof deck and the skin 30. Section 30 overlaps horizontal lip 94 of flashing 102 and sealant 99 is interposed therebetween. Mechanical fastener 103 extends into subjacent wood beams 22 to secure flashing 102 and outer edge 72 of skin section 30. Fastener 96 holds end edge beam **22*a* to deck 18 while fastener 103*a* holds end edge 76 of skin section 30 and flashing 102 in place as shown. Elbow flashing sections 106** are provided at the corners of the building and are secured in the manner described above.

The area 95 between the skin and prior to the application of the skin, is filled with a suitable insulative material. For example, a urethane or polystyrene foam can be applied by conventional techniques. Other forms of insulation such as loose rock wool or fiberglass can also be applied in this area. Thus, when the structure is completed it is impervious to moisture and due to the height of the space 95 when filled with insulation has a substantial thermal resistance (R) factor.

The roofing system as described herein can be prefabricated with the individual outer skin sections 30 and the purlin support members 24 and the peripheral edge support members 22 and **22*a*** being fabricated at a location away from the building site. All of the various parts are manufactured in accordance with the building requirements which are established initially through careful inspection and planning. The roofing system of the present invention is compatible with a large number of different wall structures and different building configurations. The totally new system maintains an attractive and aesthetically pleasing appearance while allowing expansion and contraction but also withstanding wind uplift and maintaining watertight integrity.

The roofing system of this invention can be configured to create a pitched roof as shown in FIG. 2 rather than the substantially flat roof which has been described hereabove. The roofing system, generally designated 120, is connected to an upstanding vertical wall 122 terminating at parapet 124.

Rafters 128 support a wooden deck 130. An interior ceiling (not shown) of wallboard or other finishing panel materials are applied at the underside of rafters 128. A wooden perimeter piece 132 extends around the edge of roof deck 130. The outer metal skin section 30 is preformed in accordance with the procedure described above. Rigid insulation panels 225 are disposed between the support members 132 and 142 and between purlin support members 142 and 14. Purlin support members 142 and 144 are generally Z-shaped in cross section having a vertical channel member 147 and oppositely extending flanges 146 and 148.

Upper flange 146 is slightly angled to accommodate the roof pitch. The height of purlin members 142 and 144 is selected to give an appropriate pitch to the roof. The outer skin section 30 is freely disposed over the top surface of the rigid insulation panel 225 without bonding thereto as shown in the drawings. The outer edges 70 and 72 of adjacent skin sections 30 overlap on the top of the upper flanges 146 of purlin support members 142 and 144 as shown.

The overlapping joint, generally designated 160, includes adjacent outer skin section 30 sealed by fastener 163 with a joint sealant 141 disposed between the outer edges of said skin sections 30. A secondary sealant layer 162 is applied over the fastener 163 and the outer edges and sealant 141 as shown in FIG. 4. With an inclined roofing system as shown in FIG. 2, it is desirable that the upper skin section 30 be lapped above and over the next lower skin section 30.

Rafters 128 support wooden deck 130. Interior ceiling of wallboard or other finishing panel materials applied at the underside of the rafters. A wooden perimeter piece 132 extends around the edge of the decking at the edge of the building. The outer metal skin 30 is preformed in sections as has been described with reference to previous figures. The skin is prefabricated in sections corresponding to the dimensions of the building. Skin 30 is supported on spaced apart purlins 142 and 144. The purlins are generally zee sections having a vertical channel member 147 and oppositely extending flanges 146 and 148. Upper flange 146 may be slightly angled to accomodate pitch of the roof. The height of the purlins is selected to give the necessary pitch to the completed structure. The overlapping joint 160 between adjacent skin sections 140 is as has been described above and is as shown in detail in FIG. 4 with a sealant 141 between the sections 30. With an inclined roof, it is obviously desirable to have the higher elevation section lapped over the lower elevation section. Plasticoat and membrane 162 is applied in the overlapped area and a suitable mechanical fastener 163 extends through sections 140 into flange 146 of the purlin.

As seen in FIGS. 2 and 5, cap 175 is provided on parapet 124. Cap 175 includes a generally horizontal top hanger member 176, a vertical leg 178 terminating at angular flange 180 on the front side of the parapet. At the rear side of the parapet, depending leg 182 is reversely bent at 184 forming a vertical slot 186. An angular skirt member 190 has a vertical section 192 and a base flashing portion 195 which overlays the outer edge of section 30. The vertical leg section 192 extends into slot 186 and is freely moveable therein. Base flashing is secured to the edge of roof section 130 by an interposed layer of mastic 200 and by mechanical fasteners 201 extending through flashing 195 at the edge of panel 130 into wooden perimeter piece 132. Further, sealant such as plasticoat, fiberglass mesh and an outer layer of plasticoat may be applied to further seal the joint.

Expansion and contraction of the parapet cap relative to the skirt will be accomodated in slot 186. Because of the vertical orientation of the engagement of the skirt in the slot, water will be prevented from entering under the cap. Further, the angular lip 180 at the front side of the parapet further serves to prevent entry of moisture beneath the parapet cap.

Insulation 225 is applied between roof deck 130 and outer skin section 30 and may be pre-cut in sections consistent with the roof pitch.

As depicted in FIG. 9, any roof-mounted equipment such as ventilator 150 may be sealed to skin section 30 by securing the peripheral flashing 152 to skin section 30 with fasteners 154. The area along the edge of the flashing is coated with "Plasticoat Sealant" and Fiberglass as described above.

FIG. 12 illustrates the system of the present invention retrofit to an existing roof structure having a deck 210 extending to parapet 202 with cant section 205 angularly disposed between the deck and parapet. The roof system is as has been described with preformed outer skin sections 208 being supported on purlins 210 and peripheral wood members 212.

To accommodate existing parapet flashing 215, arcuate cant flashing 220 and arcuate parapet flashing 221 are secured between the roof and parapet 202, as shown. The upper, arcuate parapet flashing 221 is secured to the edge support member 212 via mechanical fasteners 222 and a layer of sealant is applied at the lower edge thereof as shown. "Plasticoat Sealant" and a Fiberglass membrane may be applied along the upper surface of the joint. The upper edge of parapet flashing 221 terminates below the lip of the existing flashing 215. The arcuate cant flashing 220 is supported thereunder by the diagonally disposed support member 205.

The following typical installation description is believed helpful. Referring to FIGS. 1, and 3 to 10.

1. The surface of deck 18 should be cleaned and all debris removed.

2. Air conditioning ducts, evaporative cooling units and similar units, must be removed, or set on pedestal so a flashing can be installed properly.

3. All vents, caps or other obstructions 150 must be removed.

4. Once the roof surface is prepared, a grid plan as seen in FIG. 10, is used to lay out the placement of the support members 24 which extend longitudinally and may also extend transversely at the mid-point or where adjacent sections 30 overlap.

5. Following the grid plan, supports 24 are placed. Whether on wood, concrete or metal, the lay out will remain as planned except the fasteners will be changed to accept the type of deck.

6. With the supports 24 in place, the workers are ready to set the sheets of pre-cut polystyrene or other insulation 95 in place. If the roof deck has proper pitch (¼" per foot), a single thickness of insulation may be used. Following the grid plan the insulation is placed within the sections by number or color. If installed properly the insulation should be level with the top of the supports 24.

7. Once the insulation panels 95 are in place, the coiled outer skin section 30 is unrolled over a grid section without any bonding being placed between the top surface of the insulation 95 and lower surface of the skin section 30 as shown. Thus, outer skin section 30 is freely disposed over insulation 95 with the outer edges 70 and 72 being registered in alignment with the centers of adjacent support members 22 and 24. Thus, each outer skin section 30 with its parallel outer edges 70 and 72, is dimensioned to overlap the parallel support members 22 and 24 disposed on either side of the rigid insulation. Obviously, the support member 22 is along one peripheral edge of the roof deck 18 while a plurality of support members 24 may be laterally spaced across the roofing deck away from the peripheral edge. The first outer skin section 30 attached to the edge support member 22 is placed first for proper drainage. As discussed above, fasteners 103 attach the outer edge 72 to the wood edge beam 22. Fasteners 75 attach the overlapping panels at purlin 24 as shown.

8. Sealant layer or tape 69 is applied to the upper perimeter of the first row of roof skin sections 30. The second row of roof sections 30 are unrolled and aligned with the underlying support member 24 and exposed sealant layer 69. After each row of roof sections 30 have been positioned, wood planks are placed about the overlapping upper roof sections 30 as close to the sealant layer 59 as possible to compress the corrugated edge sections 70 and 72 and thereby flatten the metal against sealant layer 69 and support members 24.

The overlapping joints between adjacent rows of roof sections 30 are then secured to each other and to support members 24 by a plurality of closely spaced drive screws 75. For the type of drive screws 75 illustrated in the drawings, the screw to screw spacing should be about one and one quarter inch for a proper seal. After the second row of roof sections 30 has been installed as described above, the third and subsequent rows may be secured to support members 24 in the same manner. A particular roof section may have to be trimmed to accept roof vents, air units and other vertical obstructions. Before placing a roof skin section 30 on a grid section including a vertical obstruction, a measurement is taken and the area to overlie the obstruction is cut out. Then the roof skin section can be moved into place and screwed down. As is evident herein, the outer skin section forms a single layer of sheet material fastened securely only to the supporting frame structure and is free of any additional weight on the top thereof.

9. Flashing is the next step. There are various flashings, all custom made to fit a particular item. Parapet cap, wall flashing, air units flashing, etc. All of these are measured at the time the grid plan is layed out and manufactured for that item. Applying the flashing is done in the same manner as the roof surface. The area to be flashed is lined and taped, the flashing is set in place and screwed down through the metal flashing tape into the support. The screws should be secured about every 1½ to 2 feet apart making sure not to bunch the metal. Thereafter, the flashing may be secured at shorter intervals at approximately 1¼" making sure that they are no more than 1½" apart. Vent caps are applied in the same manner. Surface vents are applied at predetermined intervals for condensation. If there is no parapet, a perimeter flashing is applied as the first step in applying the total roof system.

10. After the flashing is secured, the roof surface should be cleaned of debris, tools, etc. An inspection at this time is required, checking all the lap seams, flashing secure points, vents, to make sure all screws are tight and there is seal tape visible at every seam. Normal walking on the roof surface will not damage it.

11. Once the area surface is clean the fibrous roof coating is applied to the lap seams and the flashing edges. This plastic coating can be applied with a brush or roller. Application will be on the lap seam approximately 10" wide and about ¼" thick. Then a membrane is layed onto the roof coating and brushed to saturate the membrane. A second coat is applied ¼" thick to cover the membrane. Once this operation is completed the roof surface should be inspected again. If every area designated for coating is complete your roof is finished. It is good practice after approximately a week to go back and flood test the surface.

The significant advantages of the roof system of the present invention become more apparent when it is considered that the present roof can be installed at about one-half the time of built-up systems. The weight/square foot of built-up systems ranges from approximately 3 to 7 times that of the present system. The thermal resistance (R) of the present roof is more than ten times that of a standard built-up roof. Field work is also substantially reduced.

An important aspect of the present invention is that a major part of the fabrication can be accomplished at the factory. The entire length of the skin sections and the supporting purlins can be pre-cut to the desired length. Thus, the site or field operations are minimized. The panel system has superior weathering, wind-lift and water resistance but is light weight and can be quickly erected with minimum labor and skill. Further, the system allows adaptation to buildings of almost any architectural size, shape and construction. Further, the system can be economically manufactured and installed. The system can be applied to new construction or it can be retrofit to existing buildings.

Further, once the system is installed it requires virtually no maintenance. The roof skin can be coated to any desired color to match the aesthetic requirements of the structure. Preferably the panels are of a light color for improved heat deflectability.

It will be obvious to those skilled in the art to make various changes, alterations and modifications to the roofing system of the present invention. To the extent these changes, alterations and modifications do not depart from the spirit and scope of the appended claims, they are intended to be encompassed therein.

I claim:

1. A multiple panel, non-rigid roofing system comprising:

a. a plurality of elongated support members each having an upper surface and being aligned to create a supporting frame formed as a plurality of grid sections, each support member having a base rigidly secured to a continuous, load bearing roof deck and an upper surface spaced apart from said roof deck by a defined height, the upper surfaces of said support members defining an elevated profile surface each segment of which is oriented substantially parallel to the immediately underlying segment of said roof deck, said roof deck defining a uniform, uninterrupted water drainage surface;

b. a filler material covering the roof deck within each grid section and extending upward from the roof deck to a level even with or below the profile surface;

c. a plurality of substantially planar, non-rigid metal panels each having an interior surface freely disposed over said filler material within a single grid section without bonding thereto and an adjoining perimeter surface overlying the upper surface of the support members of said grid section, the intersection of the perimeter surface of each panel with the perimeter surface of each adjacent panel within and above a width defined by the upper surface of said support members creating an elevated, three layer overlap zone, wherein the upper surface of said support members defines a first overlap layer, the perimeter surface of each panel defines a second overlap layer and the perimeter surface of each adjacent panel defines a third overlap layer;

d. a layer of sealant disposed within the three layer elevated overlap zone between the second and third overlap layers around the perimeter of each panel; and e. securing devices penetrating through the second and third overlap layers and the sealant layer and extending through the upper surface of said support members at spaced apart intervals within the overlap zone for compressibly securing the overlapping perimeter surfaces of adjacent panels to each other and to the support members to form an immovable watertight seal along the perimeter surface of each panel and to create a substantially flat water conveying surface over said overlap zone to facilitate the unrestricted flow of water from one substantially planar panel across said flat water conveying surface to an adjacent substantially planar panel;

whereby the interior surface of said non-rigid panels is free to expand or contract in response to temperature changes without displacing said immovable watertight seal and said plurality of non-rigid panels form a continuous, watertight membrane coincident with said profile surface and maintain the uniform, uninterrupted water drainage surface defined by the underlying roof deck.

2. The non-rigid roofing system of claim 1 wherein the contour of said continuous, watertight membrane formed by said plurality of panels is uniformly spaced above and matched to the contour of said underlying roof deck.

3. The non-rigid roofing system of claim 2 wherein each non-rigid metal panel is fabricated from metal having a flexibility comparable to thirty-gauge galvanized sheet metal or 0.24 inch aluminum sheet.

4. The non-rigid roofing system of claim 2 wherein said panels are rectangular in configuration having two sides and two ends and wherein said panels further include laterally extending corrugations.

5. The non-rigid roofing system of claim 1 wherein said filler material comprises rigid rectangular blocks of insulation.

6. The non-rigid roofing system of claim 1 wherein said roof deck forms an integral part of a single building structure and wherein said building structure includes a vertically oriented parapet wall having a vertically oriented interior surface.

7. The non-rigid roofing system of claim 6 further including flashing having a first edge forming a watertight seal with the vertically oriented surface of said parapet wall and a second edge surface forming the third overlap layer of the elevated, three layer overlap zone.

8. The non-rigid roofing system of claim 7 wherein said panels include rectangular panels having first and second sides and first and second ends and wherein said flashing extends around and is sealed to no more than one side and one end of said panel.

9. The non-rigid roofing system of claim 1 wherein said watertight membrane is formed by at least three panels.

10. The non-rigid roofing system of claim 1 wherein said watertight membrane is formed by at least four panels.

11. The non-rigid roofing system of claim 4 wherein said panels have a rectangular configuration, wherein said roof deck is inclined to form the water drainage surface and wherein the corrugations of said panels are oriented parallel to the inclination of said roof deck.

12. The non-rigid roofing system of claim 1 wherein said overlap zone includes a layer of sealant material applied above the third overlap layer and above said securing devices to form a secondary, watertight seal.

13. The non-rigid roofing system of claim 1 wherein the panel secured to one grid section is substantially coplanar with an adjacent panel secured to an adjacent grid section.

14. The non-rigid roofing system of claim 1 wherein each grid section is at least about twelve feet wide.

15. The non-rigid roofing system of claim 6 including a water barrier sealed to the vertically oriented interior surface of said parapet wall and extending along and sealed to the perimeter of the water impervious membrane formed by said plurality of panels to seal said watertight membrane to said parapet wall.

16. The non-rigid roofing system of claim 15 wherein said water barrier includes flashing for sealing the perimeter of said water impervious membrane to the vertically oriented interior surface of said parapet wall.

17. The non-rigid roofing system of claim 1 wherein each panel includes a length and a width and wherein the length of said panel is substantially greater than the width of said panel.

* * * * *